US006328029B1

(12) United States Patent
Nuter

(10) Patent No.: US 6,328,029 B1
(45) Date of Patent: Dec. 11, 2001

(54) PORTABLE, VENTLESS CAST IRON STOVES

(75) Inventor: Paul J. Nuter, 212 83rd St., Hinsdale, IL (US) 60521

(73) Assignee: Paul J. Nuter, Elmhurst, IL (US)

( * ) Notice: Subject to any disclaimer, the term of this patent is extended or adjusted under 35 U.S.C. 154(b) by 0 days.

(21) Appl. No.: 09/357,980

(22) Filed: Jul. 21, 1999

(51) Int. Cl.[7] ..... F24C 1/00; F24C 15/02

(52) U.S. Cl. ..... 126/58; 126/194; 126/25 R; 126/4; 126/19 M; 49/397; 16/263

(58) Field of Search ..... 126/58, 59, 275 R, 126/500, 505, 65, 85 A, 43, 84, 21 R, 19 M, 25 R, 29, 9 R, 4, 194; 49/397; 16/229, 232, 263, 271

(56) References Cited

U.S. PATENT DOCUMENTS

| | | | | |
|---|---|---|---|---|
| 59,119 | * | 10/1866 | Batchelor | 126/194 |
| 481,768 | | 8/1892 | Myers . | |
| 1,502,576 | * | 6/1924 | Lange | 126/194 |
| 1,879,954 | | 9/1932 | Smith . | |
| 2,511,515 | * | 6/1950 | Schmitt | 126/9 R |
| 2,803,240 | | 8/1957 | Howell . | |
| 2,933,080 | * | 4/1960 | Adey | 126/25 R |
| 3,140,705 | | 7/1964 | Dry . | |
| 3,880,139 | * | 4/1975 | Young | 126/9 R |
| 4,154,212 | | 5/1979 | Wilkinson . | |
| 4,230,091 | | 10/1980 | Judge et al. . | |
| 4,261,325 | | 4/1981 | Duncan et al. . | |
| 4,326,495 | | 4/1982 | Millar . | |
| 4,351,314 | | 9/1982 | Morton . | |
| 4,370,973 | * | 2/1983 | Bolanos | 126/58 |
| 4,545,359 | * | 10/1985 | Hait | 126/9 R |
| 4,558,687 | * | 12/1985 | Minshall et al. | 126/59 |
| 4,691,688 | | 9/1987 | Urso . | |
| 5,067,396 | * | 11/1991 | Sorensen et al. | 126/9 R |
| 5,222,475 | * | 6/1993 | Greener | 126/25 R |
| 5,687,704 | * | 11/1997 | Lerch et al. | 126/25 R |
| 5,722,387 | * | 3/1998 | Chen | 126/43 |

* cited by examiner

*Primary Examiner*—Ira S. Lazarus
*Assistant Examiner*—Josiah C. Cocks
(74) *Attorney, Agent, or Firm*—Sonnenschein Nath & Rosenthal

(57) ABSTRACT

A heating stove for burning a gelled alcohol fuel is provided which is constructed of cast iron, yet nevertheless, is compact and light enough for one person to move. The stove is constructed of a minimum of parts, with a duplication of some parts, to minimize production and assembly costs and time. The stove provides for visibility of the burning flame of the fuel and yet confines the flame for safety considerations.

19 Claims, 4 Drawing Sheets

PORTABLE, VENTLESS CAST IRON STOVES

BACKGROUND OF THE INVENTION

The present invention relates to the use of cast iron in the manufacture of portable stoves for use by the general public. More specifically, the stove of the present invention is designed to burn cans of fireplace fuel better known as gelled alcohol, and for this reason the stove has been designed without exterior venting capabilities.

Stoves in use today for heating an indoor enclosed space are generally made of welded steel construction, cast iron or a combination of both for use in cooking and heating. Some stoves are designed for the use of natural gas as the fuel. These stoves may be ventless, but at the same time require a connection to a gas supply. Like woodburning stoves, once they are in place, they cannot easily be moved about without the need to either re-vent (if they have a vent) or at least be connected to a new gas line. Also these types of stoves are generally heavy and require several people to be able to move them. As with the ventless gas burning stoves, there is also the concern of oxygen depletion and the build up of carbon monoxide within the space being heated. This is also true of the fake fireplaces that burn gelled alcohol. Their design incorporates the use of burning two to four cans of the fuel at the same time. Of course this problem can be minimized and even eliminated by an opening of a window to allow for a fresh air flow, but the potential for this hazard remains and if the stove is being used as source of heat, having a window open even an inch will take away from the efficiency of the stove to heat a room.

Many of the existing stove designs are quite complicated and comprise a large number of parts requiring difficult and time consuming assembly.

SUMMARY OF THE INVENTION

The size of the stove of the present invention has been scaled down from most wood or gas burning stoves to reduce the weight to below 75 pounds and thus to make it light enough for any one person to pick up and carry or move. Because this stove does not require exterior venting, it can be used anywhere in the home and outside. The design makes the stove decorative as well as functional. That is, the stove will provide immediate heat by convection due to vent openings provided in a top grill plate, and long lasting, even, radiant heat due to the cast iron construction and shape of the stove body. The stove is designed to burn only one can of gelled alcohol at any one time, thus eliminating the concerns of oxygen depletion associated with an open flame in a closed room. By using gelled alcohol, this stove does not produce air pollutants and therefore does not have to be cleaned of any remaining soot and ash such as left behind from the burning of wood or coal.

It is therefore an object of the present invention to provide a stove having complete mobility and ease of use.

It is a further object of the invention to provide a stove that combines both the warmth and charm of a fireplace or a woodburning stove with the ambiance of burning candles.

It is a further object to provide a stove that can truly be portable, can be used where space is at a premium and is functional as well as decorative.

It is a further object to provide a stove which can be easily assembled with a minimum of parts, and, specifically, with a minimum of different parts.

Other objects and advantages of the present invention are described below with respect to an embodiment shown in the drawings.

DETAILED DESCRIPTION OF THE PREFERRED EMBODIMENTS

Figure 2:
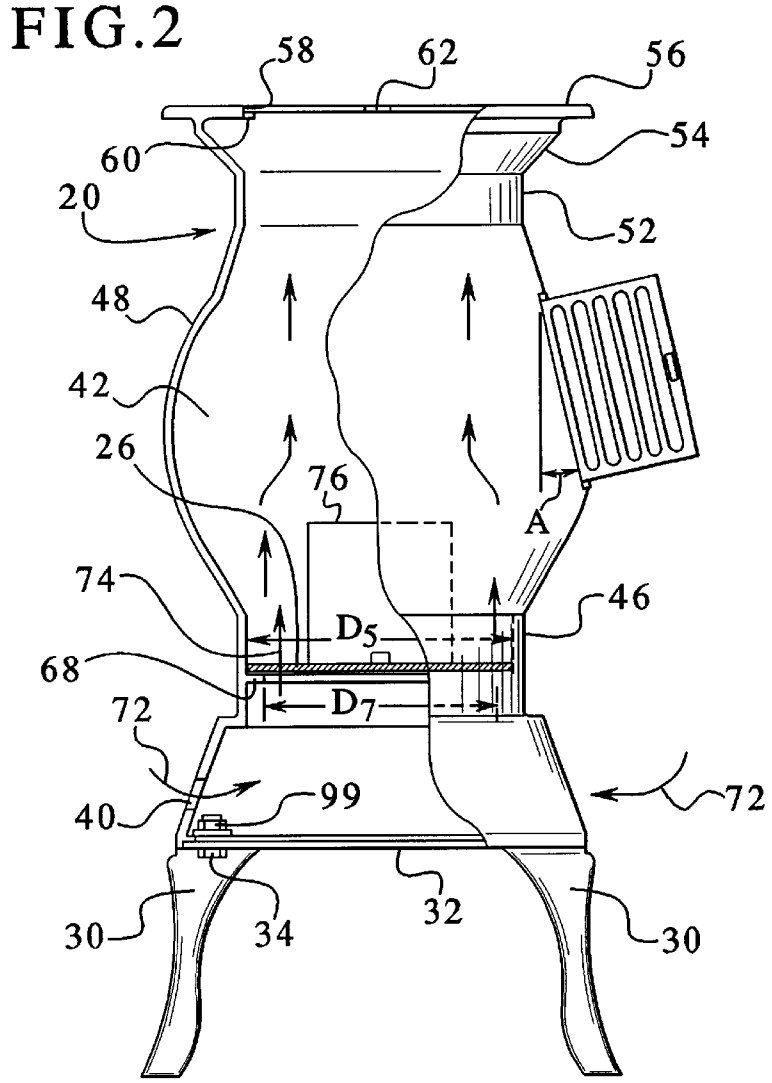
FIG. 2 is a side elevational view, partially cut away, of the stove of FIG. 1.
Figure 1:
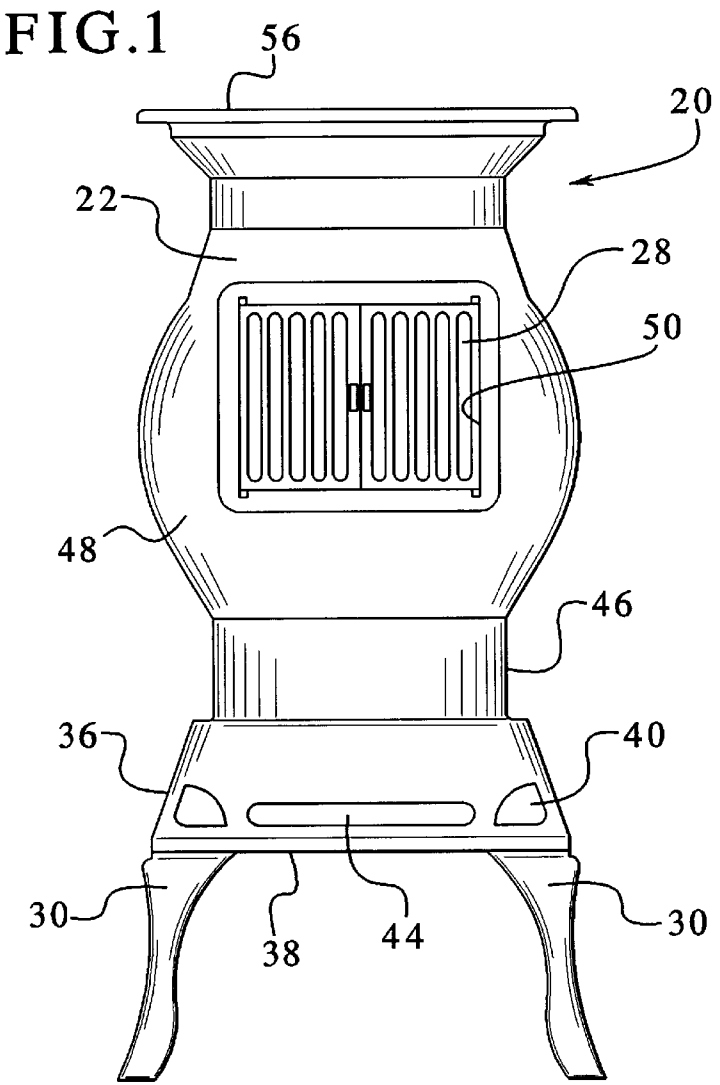
FIG. 1 is a front elevational view of a stove embodying the principles of the present invention.
Figure 4:
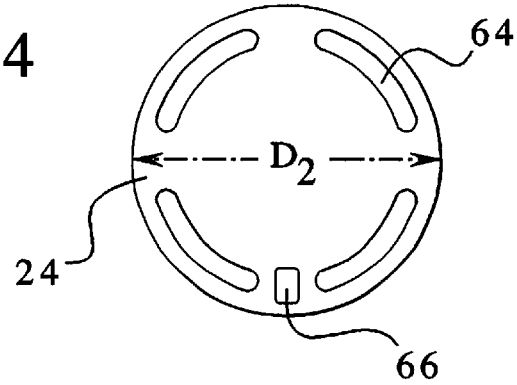
FIG. 4 is a plan view of a top grill for the stove of FIG. 1.
Figure 5:
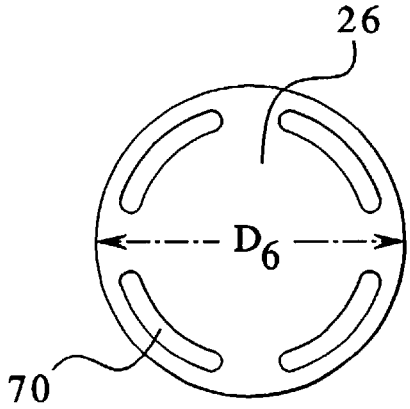
FIG. 5 is a plan view of a support grill for the stove of FIG. 1.
Figure 7:
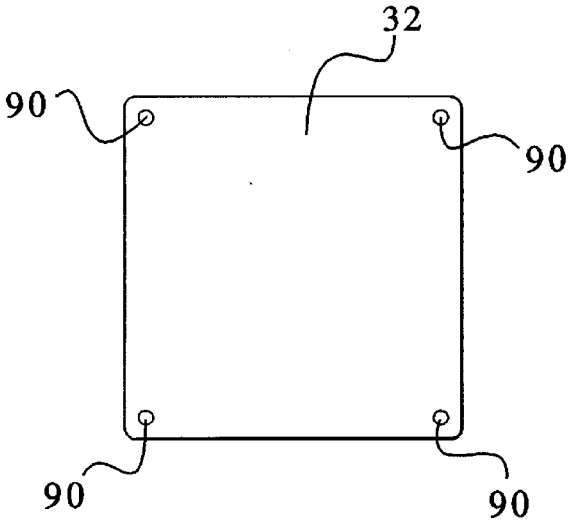
FIG. 7 is a plan view of a metal sheet to be used in the stove of FIG. 1.

The present invention provides an improved stove 20 as best shown in FIGS. 1 and 2 which is comprised of several individual parts: a main body portion 22, a grill member 24 (FIG. 4), a shelf member 26 (FIG. 5), a door structure 28 (FIG. 10), a plurality of leg members 30 (FIGS. 8 & 9), a bottom plate 32 (FIG. 7) and fasteners 34.

The main body portion 22 is preferably formed as a single piece casting from cast iron. The main body portion has a base area 36 with a flat bottom wall 38. In the base area 36 there are provided a plurality of air inlet vent openings 40 which provide for the inlet of combustion air to an interior 42 of the stove. Further, a clean out vent slot and enlarged vent opening 44 may be provided in the base area 36, on at least one side thereof. The base area 36 may have a frusto pyramidal shape with four equal length sides, with one of the legs 30 being attached at the bottom wall 38 at a comer of each two adjacent sides.

Figure 3:
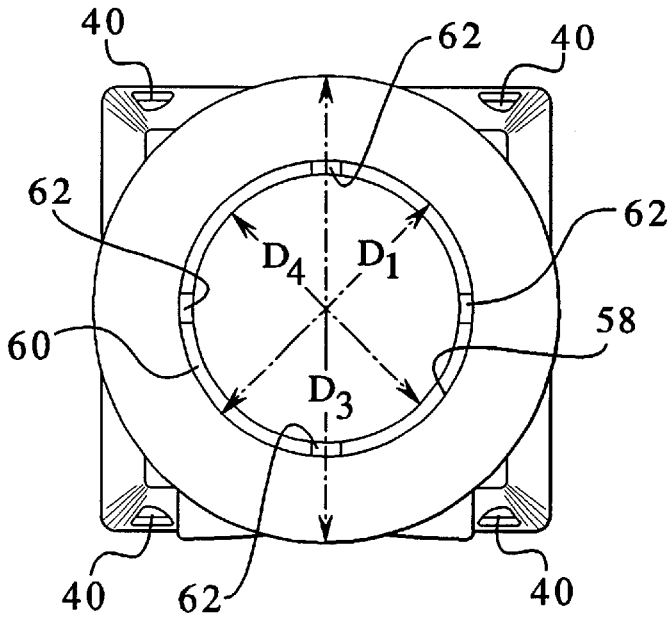
FIG. 3 is a plan view of the stove of FIG. 1.

Positioned above the frusto-pyramidal shaped base area 36 of the main body portion 22 is a cylindrically shaped transition area 46 and positioned above the transition area 46 is a pot belly shape area 48. On one side of the pot belly area 48 is an opening 50 (FIG. 10) which preferably is rectangular in shape and which receives the door structure 28. Positioned above the pot belly shaped area 48 is a short cylindrical chimney area 52 and above the chimney area is an inverted frusto-conical top area 54 having an enlarged flat top surface 56. Within the top surface 56 is an opening 58. The opening 58 has a diameter $D_1$ which is slightly greater than a diameter $D_2$ of the grill member 24 (FIG. 3).

As mentioned, the main body portion 22 is preferably formed of cast iron of a suitable thickness, such as ¼", in order to enhance the ability of the stove to provide radiant heat, which is further enhanced by the pot belly shape of the stove. Such radiant heat provided through cast iron gives a longer lasting and more even heat than convection heat directly from burning fuel.

In order to assure portability of the stove of the present invention, the stove is sized such that the total weight of the stove will not exceed that which could be relatively easily moved by an individual. Thus, the fully assembled stove, with all components, is preferably sized and constructed such that it has a weight of less than about 75 pounds, and more preferably less than about 60 pounds. In one embodiment, in order to accommodate the weight requirements, the main body portion, from the top surface 56 to the bottom wall 38 has a dimension of about 19½" with the top surface 56 being generally circular with a diameter $D_3$ of about 11½". The bottom wall 38 is preferably about 11" square. When the main body portion 22 is made of cast iron of an approximate thickness of ¼", the weight of the main body portion would be about 49 pounds.

The grill member 24 (shown separately in FIG. 4) is also preferably formed of cast iron with a diameter of about 7". When this grill member is made of cast iron with a thickness of about 3/16", it has an approximate weight of 1.75 pounds.

The opening 58 in the top wall 56 preferably has a diameter of about 7⅛" so that it will easily accommodate the grill member 24. A segmented ledge 60 is provided around the circumference of the opening 58 with opposed slots 62 providing areas where the full diameter $D_1$ of the opening 58 is unrestricted. The ledge 60 has an internal diameter $D_4$ preferably of about 6½" so that it is sized less than the diameter $D_2$ of the grill member 24. Thus, the grill member 24 will be supported on the ledge 60 with a top surface of the grill member 24 being flush with the top surface 56 of the main body portion 22.

The grill member 24 is provided with a plurality of vent openings 64 to allow heated air and exhaust gases to exit from the interior 42 of the stove 20. Also, the grill member 24 is provided with a tab 66 projecting from a bottom surface thereof which can be positioned within one of the slots 62 to prevent rotation of the grill member on the ledge 60.

The shelf member 26 (shown separately in FIG. 5) is preferably formed identical to the grill member 24 in shape, size and material except that it does not include the tab 66. Such an arrangement allows for reduced manufacturing costs.

In the interior 42 of the body portion 22, and specifically within the cylindrical transition area 46, there is provided an internal ledge 68 for receiving and supporting the shelf member 26. Thus, an internal open diameter $D_5$ (see FIG. 6) of the cylindrical portion 46 is sized slightly greater than a diameter $D_6$ of the shelf member 26 so that the shelf member 26 can be received within the interior of the cylindrical portion 46. It is also therefore preferred that an internal diameter $D_7$ of the ledge 68 is dimensioned smaller than the diameter $D_6$ of the shelf member 26 so as to provide vertical support for the shelf member.

The shelf member 26 could also have a larger diameter than the diameter $D_5$ of the cylindrical portion, and would thereby rest on the interior surface of the pot belly shaped portion 48. However, it is preferred to provide the ledge 68 so that the shelf member 26 will always assume a horizontal, level orientation.

Of course it is also possible to form the transition area 46 and/or the shelf member 26 in a shape other than circular, the main consideration being that there be provided horizontal support for the shelf member 26 within the interior of the main body portion 22.

As with the grill member 24, the shelf member 26 is provided with a plurality of air vents 70 which permit the passage of air flowing in through the air inlets 40, as shown by arrows 72 to flow through the shelf member 26 as indicated by arrow 74 to provide combustion air to fuel located in a fuel container 76 which is supported on the shelf member 26. The products of combustion and heated air will continue to rise within the interior 42 of the main body portion 22 by convection, in the process heating the main body portion 22, and will continue upward through the outlet vents 64 in the grill member 24.

Although the grill member is shown as being circular in shape, it also could be formed of different geometric shapes. However, by providing the grill member 24 and shelf member 26 with the same size and shape, and by providing the opposed slots 62 in the ledge 60 at opening 58, it is possible to insert the shelf member 26 by holding it vertical and passing it through the slots 62, and then rotating the shelf member to a horizontal orientation to place it on the lower ledge 68. Alternatively, the opening 50 in the side of the pot belly portion 48 can be sized to accommodate the shelf member 26 therethrough, either horizontally, vertically or diagonally.

Figure 6:
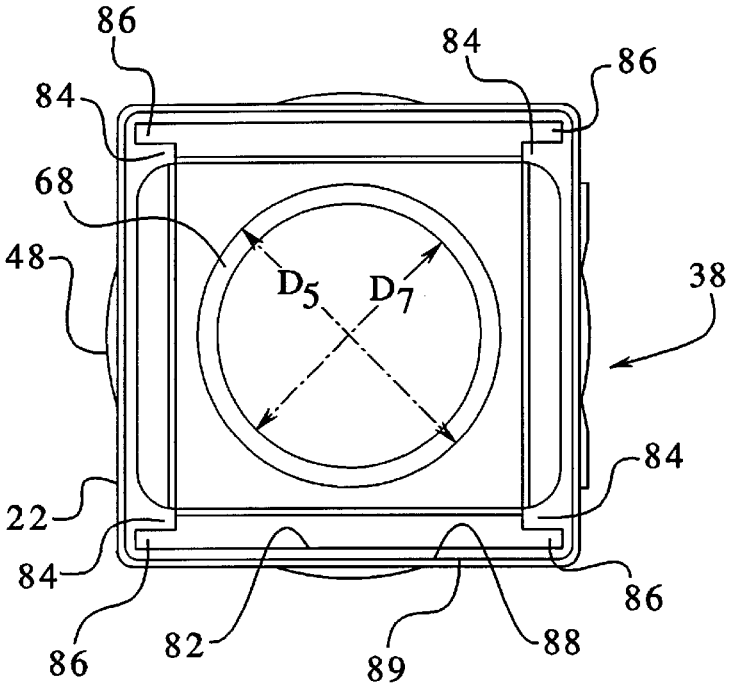
FIG. 6 is a bottom elevational view of the stove body of FIG. 1.

As seen in FIG. 6, the main body portion 22 has an irregularly, but symmetrically shaped opening 82 formed in the bottom wall 38 thereof. The shape of the opening 82 is substantially square, however there are four laterally projecting fingers 84 which define slot areas 86 in each corner of the bottom. A square recess 88 defined by an outer perimeter rim 89 surrounds the opening 82 for receiving the bottom plate 32. The bottom plate 32, which can be formed of a lightweight non-flammable material, such as aluminum, has an opening 90 formed near each corner thereof which aligns with the slot areas 86 in the main body portion.

Figure 8:
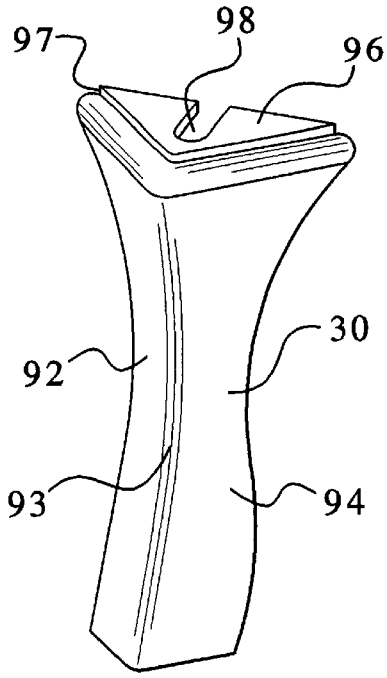
FIG. 8 is a front perspective view of a support leg to be attached to the stove of FIG. 1.
Figure 9:
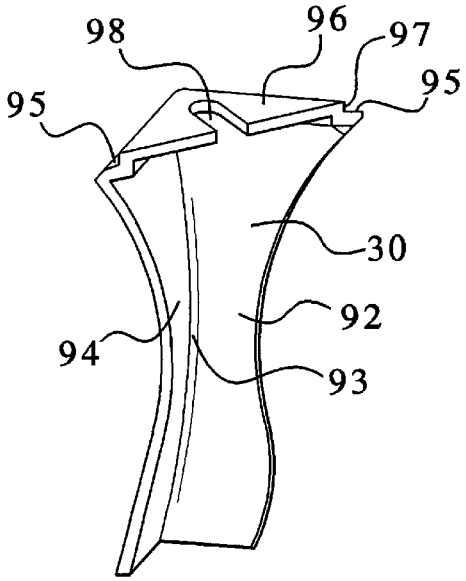
FIG. 9 is a rear perspective view of the support leg of FIG. 8.

The leg members 30 are shown in isolated detail in FIGS. 8 and 9 where it is seen that they are formed of two vertical walls 92, 94 joined along one edge 93 and arranged generally perpendicular to one another to form a horizontal L cross section. At a top end there is a horizontal wall 96 joining the two vertical walls 92, 94 and having a generally triangular shape which is offset inwardly at 95 from the two vertical walls 92, 94, and elevated by a short vertical wall 97 above a top end of vertical walls 92, 94. A slot 98 is formed in the top wall 96.

In the preferred arrangement as shown in the drawings, the legs 30 can be attached to the main body portion 22 by fasteners 34, such as a threaded bolts. Preferably, the threaded bolt has a large head 99 which is captured against rotation by interior surfaces of the sidewalls of the base member 36 such that a separate tool is not required to be used to hold the bolt against rotation during assembly. A shank portion of the bolt extends down through the slot area 86 of the bottom wall 38, through the opening 90 in the bottom plate 32. A washer, having a diameter greater than the width of the slot 98 in the leg 30 is placed over the shank of the fastener and a nut is loosely threaded onto the shank to provide a loose assembly of the fastener. The leg 30 is then slipped onto the bolt shank, by means of the slot 98, and the leg is seated with the top wall 96 abutted against the bottom plate 32 and the offset 95 and vertical wall 97 abutted against the outer perimeter rim 89 of the bottom wall 38, so that the leg itself is interlocked with the main body portion 22 against rotation. The nut is then tightened on the shank to provide a clamping action between the head and the nut, capturing the top wall 96 of the leg, the bottom plate 32 and the finger 84 of the main body portion 22 in an assembled relationship. The vent openings 40 in the base area 36 provide access to the fastener 36 to assist in assembly and disassembly of the leg members. Alternatively, the fasteners can be accessed through the open interior 42 of the main body portion 22 either through the door opening 50 or the top opening 58.

In the preferred embodiment, the legs may also be formed of cast iron, with all four legs being identical in shape and size and having a vertical dimension of approximately 6" and a thickness of about 3/16" to ¼", so that each leg would have an approximate weight of 0.8 pounds.

Figure 10:
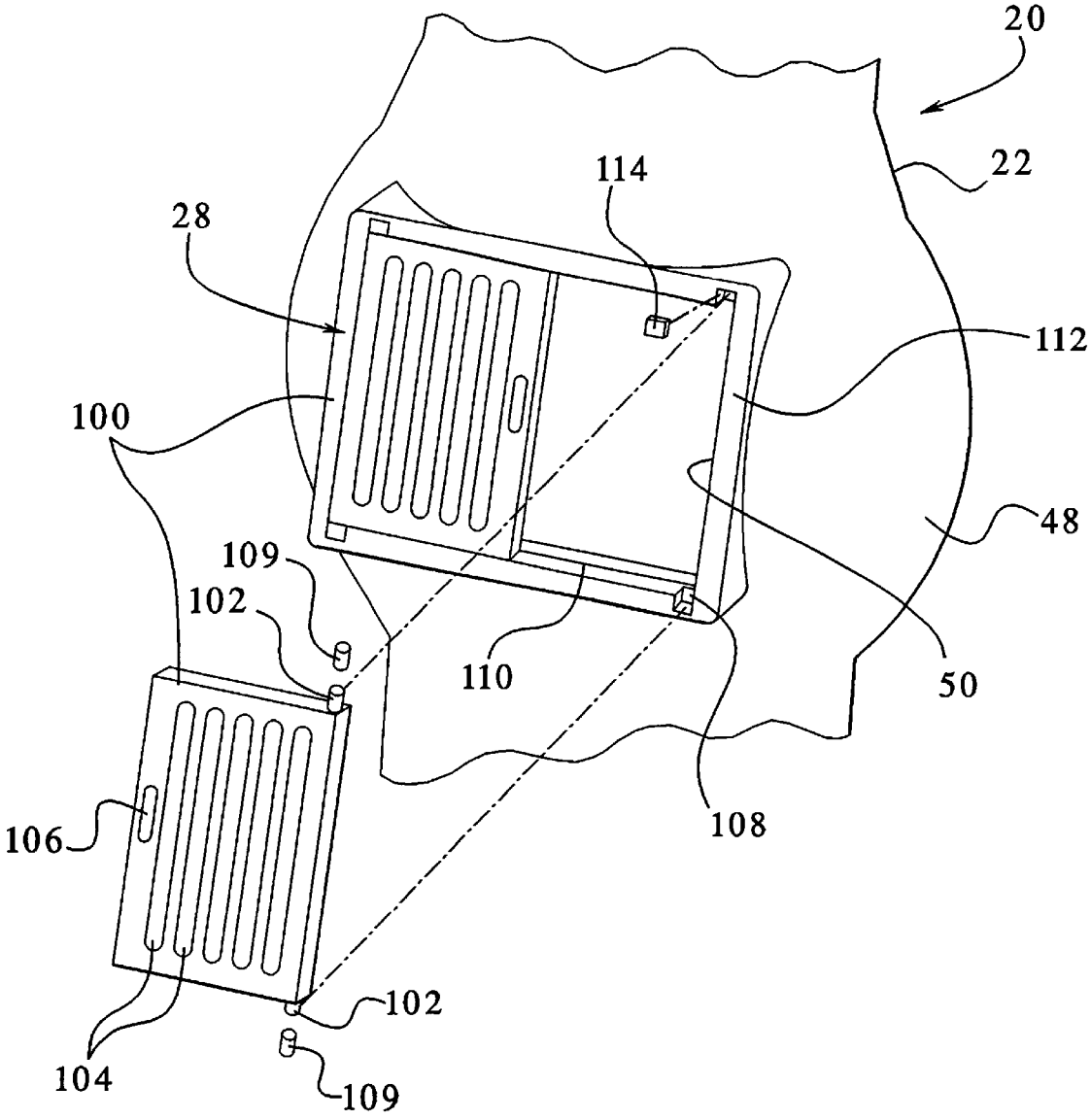
FIG. 10 is an exploded view of the door assembly for the stove of FIG. 1.

The door structure 28 is shown in greater detail in FIG. 10 where it is seen that it is comprised of two identical door members 100. The door members 100 are provided with hinge pins 102 projecting from a top and bottom edge at one side of the door and with a plurality of openings 104, shown in the form of vertical slots through the door. The doors are also provided with a handle tab 106 projecting from a front surface thereof on a side opposite the side having the hinge pins 102.

The door opening 50 is provided with four recess areas or pockets 108 at each comer to receive the hinge pins 102 and brass bearings 109 of the door members 100. The door opening is also provided with a lip 110 surrounding, but recessed within the opening 50 to provide an abutment stop for a back side of the doors. The opening 50 is sized vertically and horizontally to receive the vertical and horizontal width of the two door members 100 placed side-by-side and to provide some clearance to accommodate expansion and contraction. The bearings 109 are placed onto the hinge pins 102 and then the door members 100 are placed within the door opening 50 and against the lip 110 so that the front face of the door members 100 will be essentially flush with a front face 112 of an area surrounding the door opening 50. The bearings 109 preferably have an internal diameter greater than an outer diameter of the hinge pins and an outer diameter slightly greater than the recesses 108 so that the bearings will need to be press fit into the recesses which will hold them securely in place, yet the hinge pins will be able to easily rotate within the bearings. Wedge members 114 are hammered into the recesses 108 which already contain the hinge pins 102 and bearings 109 to lock the hinge pins and bearings within the recesses. In this manner, the door members 102 will therefore be securely retained within the opening 50, yet free to pivot between open and closed positions.

Although the embodiment illustrated provides two identical doors which open at the center, a single door pivoted at one side, the top or the bottom could also be provided.

The openings 104 provide visual access into the interior 42 of the pot belly portion 48, and in particular to the area of the fuel container 76, so that the burning condition of the fuel can be visually checked. This also provides the visual aesthetics of a burning flame.

It is preferred that the door opening 50 be tilted from vertical, such as by an angle A (FIG. 2) of about 11° whereby a top end of the door opening is positioned rearward of a bottom end. In this manner, the door members 100 will be held in a closed position by gravity when they are flush with the surrounding surface 112. Such an angle also provides a more direct line of sight toward the fuel container 76.

In the preferred embodiment, the door opening generally has a horizontal dimension of about 6½" and a vertical dimension of about 5", with each door having a vertical dimension of about 5" and a horizontal dimension of about 3¼", with appropriate clearances being provided. Thus, when the doors are formed of cast iron, they each would have a weight of approximately 0.37 pounds.

Thus, the assembled weight of the stove, comprising the main body portion 22, the grill 24, the shelf 26, the door structure 28, the four legs 30, the bottom shelf 32 and fastening members 34 will be less than about 75 pounds and, in the particular embodiment illustrated and described, could be less than about 60 pounds. Thus, the size, shape and weight of such a stove render it portable and allow for its relatively easy movement by a single person. Nevertheless, its construction including its shape and the use of cast iron, allows the stove to provide both fast convective heat as well as long lasting and even radiant heat and also permits the viewing of the burning flame of the fuel, while enclosing the flame and fuel so as to substantially reduce any risk of uncontrolled fire. The size, shape and construction of the stove render it quite stable and combined with the weight of the stove substantially prevents any accidental tipping of the stove through bumping or other similar actions. The relatively small number of parts to be assembled and the duplication of some parts renders the stove economical and easy to manufacture and assemble. The stove can also be opened and disassembled easily for cleaning, storing or shipping.

Although a particular embodiment of the stove is shown and described, it can be appreciated that the present invention could be arranged with other specific configurations and arrangements while still keeping within the scope of the claims set forth below.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A stove comprising:

a main body portion having a top exterior surface with an opening therethrough and a sidewall with an opening therethrough;

a grill member sized to be held at said top exterior surface opening to form a part of said top surface;

a shelf member sized to fit through an opening in said main body and to be retained in said main body to form a fuel receiving shelf within said body; and a door structure pivotally attached to said body adjacent said sidewall opening and being sized to substantially close said sidewall opening;

said door structure comprising at least one door with a pair of hinge pins projecting from said door, said body portion having pockets adjacent to said side wall opening for receiving said hinge pins, and including wedge members frictionally retained in said pockets for retaining said hinge pins within said pockets.

2. A stove according to claim 1, wherein said grill member and said shelf member are identical in size and shape.

3. A stove according to claim 1, wherein said grill member has a plurality of vent openings therethrough.

4. A stove according to claim 1, wherein said shelf member has a plurality of vent openings therethrough.

5. A stove according to claim 1, wherein said grill member has a tab projecting therefrom.

6. A stove according to claim 1, wherein said door structure further comprises a separate bearing member received on each hinge pin.

7. A stove according to claim 1, wherein said door structure comprises two identical door members.

8. A stove according to claim 7, wherein said door members each have a plurality of vent openings therethrough.

9. A stove according to claim 7, wherein said door members each have a handle tab projecting therefrom.

10. A stove according to claim 1, wherein said body, grill member, shelf member, and door structure are each formed of cast iron.

11. A stove according to claim 10, wherein said stove is dimensioned and constructed so as to weigh less than about 75 pounds.

12. A stove according to claim 1, wherein said main body portion includes air intake vents extending through said sidewall below said shelf member.

13. A stove according to claim 1, including a plurality of leg members attached to a bottom of said body to hold said body above a support surface and wherein each of said legs are detachably retained on said body by a single threaded bolt and interlocked with said body to prevent rotation of said legs relative to said body.

14. A stove according to claim 1, wherein said sidewall opening has a perimeter for receiving said door structure, said perimeter being offset from vertical, with a top end rearward of a bottom end, such that said door structure will be held in a closed position due to gravity.

15. A stove according to claim 1, including a substantially solid bottom plate attached to a bottom of said main body portion to close a bottom opening of said main body portion to prevent fuel or debris from within said main body portion from falling outside of said stove.

16. A stove according to claim 1, wherein a clean out vent slot is formed on said sidewall of said stove below said sidewall opening.

17. A stove according to claim 1, including a plurality of leg members removably attached to a bottom of said body portion, each by a single threaded bolt, and interlocked with said body portion to prevent rotation of said legs relative to said body portion to hold said body portion above a support surface.

18. A stove comprising:

a main body portion formed of cast iron and having a top exterior surface with an opening therethrough and a sidewall with an opening therethrough;

a grill member formed of cast iron and sized to be held in said top exterior surface opening to form a part of said top surface;

a shelf member formed of cast iron in a size and shape identical to said grill member and being sized to fit through an opening in said main body and to be retained in said main body to form a fuel receiving shelf within said body; and a door structure formed of at least one cast iron door member pivotally attached to said body adjacent said sidewall opening and being sized to substantially close said sidewall opening;

said sidewall opening having a perimeter for receiving said door member, said perimeter being offset from vertical, with a top end rearward of a bottom end, such that said door member will be held in a closed position due to gravity;

wherein said stove is dimensioned and constructed so as to weigh less than 75 pounds.

19. A stove comprising:

a main body portion formed of cast iron and having a top exterior surface with an opening therethrough and a sidewall with a door opening therethrough and a vent slot therethrough below said door opening;

a grill member formed of cast iron and sized to be held in said top surface opening on a ledge around a circumference of the opening to form a part of said top surface with a top surface of the grill member being flush with the top exterior surface of the main body portion, said grill member having a plurality of vent openings therethrough and a tab projecting therefrom;

a shelf member formed of cast iron in a size and shape identical to said grill member and being sized to fit through an opening in said main body and to be retained in said main body to form a fuel receiving shelf within said body, said shelf member having a plurality of vent openings therethrough;

said main body portion including air intake vents extending through said sidewall below said shelf member;

a door structure formed of two identical cast iron door members each pivotally attached to said body adjacent said sidewall door opening and being sized to substantially close said sidewall door opening;

said door members including hinge portions including separate hinge bearings, said body portion having pockets adjacent to said sidewall opening for receiving said hinge portions, and said stove including wedge members frictionally retained in said pockets for retaining said hinge portions within said pockets;

said door members having a plurality of vent openings therethrough and a handle tab projecting therefrom;

said sidewall door opening having a perimeter for receiving said door members, said perimeter being offset from vertical, with a top end rearward of a bottom end, such that said door members will be held in a closed position due to gravity;

a substantially solid bottom plate attached to a bottom of said main body portion to prevent fuel or debris from within said main body portion from falling outside of said stove; and a plurality of leg members removably attached to said bottom of said body, each by a single threaded bolt and interlocked with said body to prevent rotation of said legs relative to said body to hold said body above a support surface, wherein said stove is dimensioned and constructed so as to weigh less than about 75 pounds.

* * * * *